US009976769B2

(12) United States Patent
Shinoda et al.

(10) Patent No.: US 9,976,769 B2
(45) Date of Patent: May 22, 2018

(54) INDOOR UNIT OF AIR-CONDITIONING APPARATUS

(71) Applicant: Mitsubishi Electric Corporation, Tokyo (JP)

(72) Inventors: Ippei Shinoda, Tokyo (JP); Kazuhiko Kawai, Tokyo (JP); Yuki Mochizuki, Tokyo (JP); Satoshi Kusutani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 25 days.

(21) Appl. No.: 15/112,254

(22) PCT Filed: Mar. 27, 2014

(86) PCT No.: PCT/JP2014/001785
§ 371 (c)(1),
(2) Date: Jul. 18, 2016

(87) PCT Pub. No.: WO2015/145483
PCT Pub. Date: Oct. 1, 2015

(65) Prior Publication Data

US 2016/0334129 A1 Nov. 17, 2016

(51) Int. Cl.
*F24F 13/22* (2006.01)
*F24F 1/00* (2011.01)
(Continued)

(52) U.S. Cl.
CPC ..... *F24F 13/222* (2013.01); *F24F 1/0007* (2013.01); *F25B 39/02* (2013.01);
(Continued)

(58) Field of Classification Search
CPC ..... F24F 13/222; F24F 1/007; F25B 39/02; F25B 2339/02; F28D 1/0477; F28D 1/0443; F28F 17/005
See application file for complete search history.

(56) References Cited

U.S. PATENT DOCUMENTS 4,000,779 A * 1/1977 Irwin ..... B01D 45/06 165/111

FOREIGN PATENT DOCUMENTS

JP 56-23876 U 3/1981
JP 10-009665 A 1/1998
(Continued)

OTHER PUBLICATIONS

Office Action dated Dec. 13, 2016 issued in corresponding JP patent application No. 2016-509608 (and English translation).
(Continued)

*Primary Examiner* — Emmanuel Duke
(74) *Attorney, Agent, or Firm* — Posz Law Group, PLC

(57) ABSTRACT

An indoor unit of an air-conditioning apparatus includes a body casing having an air inlet formed in an upper portion of the body casing and an air outlet formed in a lower portion of the body casing; a ventilation passage formed in the body casing; an evaporator provided to a refrigerant circuit, disposed in an inclined manner in the ventilation passage, and covering the ventilation passage such that air freely passes; a main drain pan disposed below the evaporator; and a fan disposed in the ventilation passage. The evaporator is divided into an upper heat exchanger and a lower heat exchanger. A sub-drain pan that receives dew condensation water coming out from a gap of the joint is disposed at a downstream side in a ventilation direction of a joint between the upper heat exchanger and the lower heat exchanger.

6 Claims, 4 Drawing Sheets

(51) Int. Cl.

| | |
|---|---|
| ***F28D 1/04*** | (2006.01) |
| ***F28F 17/00*** | (2006.01) |
| ***F28D 1/047*** | (2006.01) |
| ***F25B 39/02*** | (2006.01) |

(52) U.S. Cl.
CPC ..... *F28D 1/0443* (2013.01); *F28D 1/0477* (2013.01); *F28F 17/005* (2013.01); *F25B 2339/02* (2013.01)

(56) References Cited

FOREIGN PATENT DOCUMENTS

| | | | | |
|---|---|---|---|---|
| JP | 2000-274721 | A | | 10/2000 |
| JP | 2008-089250 | A | | 4/2008 |
| JP | 2008089250 | A | * | 4/2008 |
| JP | 2009-063203 | A | | 3/2009 |
| JP | 2009063203 | A | * | 3/2009 |
| JP | 2009-243801 | A | | 10/2009 |
| JP | 2009243801 | A | * | 10/2009 |

OTHER PUBLICATIONS

International Search Report of the International Searching Authority dated Jul. 1, 2014 for the corresponding International application No. PCT/JP2014/001785 (and English translation).

* cited by examiner

INDOOR UNIT OF AIR-CONDITIONING APPARATUS

CROSS REFERENCE TO RELATED APPLICATION

This application is a U.S. national stage application of PCT/JP2014/001785 filed on Mar. 27, 2014, the contents of which are incorporated herein by reference.

TECHNICAL FIELD

The present invention relates to an indoor unit of an air-conditioning apparatus, and, more particularly, relates to prevention of dispersion of dew condensation water generated on a surface of an evaporator.

BACKGROUND

Hitherto, as an indoor unit of an air-conditioning apparatus for a computer room, a unit that blows out air from a lower portion of a casing of the indoor unit is known. In general, in the indoor unit of the air-conditioning apparatus of such a downward blow-out type, with a heat exchanger being a boundary, a primary side (an upstream side in a ventilation direction) corresponds to an upper position, and a secondary side (a downstream side in the ventilation direction) corresponds to a lower position. In the indoor unit, when an air-conditioned space is cooled, dew condensation water is generated on a surface of a heat exchanger, which serves as an evaporator. Wind that passes between fins of the heat exchanger disperses the dew condensation water, and may cause the dew condensation water to leak to the outside of the unit.

As means for preventing such a dispersion of dew condensation water, a sub-drain pan is used. In the indoor unit in which the secondary side of the heat exchanger corresponds to a lower position, an operation state in which dew condensation water cannot be collected by only using a main drain pan may occur. In such a case, when the sub-drain pan is provided together with the main drain pan, dew condensation water received by the sub-drain pan can be conveyed to the main drain pan. A technology related to such an existing sub-drain pan is disclosed in, for example, Patent Literature 1 below. Patent Literature 1 describes an air-conditioning apparatus including a movable sub-drain pan. In the air-conditioning apparatus, when an operation state in which dew condensation water is not generated occurs, to reduce ventilating resistance caused by the sub-drain pan, the angle of the sub-drain pan can be changed.

On the other hand, in the indoor unit of the existing air-conditioning apparatus, to reduce production cost of the heat exchanger, there may be a case in which the heat exchanger is produced with the heat exchanger divided into an upper heat exchanger and a lower heat exchanger, and, when the heat exchanger is mounted on the indoor unit, the divided portions of the heat exchanger are connected to each other to obtain a predetermined heat exchanger capacity. In particular, a method of producing a high-capacity heat exchanger used in an indoor unit of a large air-conditioning apparatus differs from a method of producing a relatively small heat exchanger, so that production costs increases. To reduce the production costs, the above-described means is used to provide the predetermined heat exchanger capacity in the indoor unit.

PATENT LITERATURE

Patent Literature 1: Japanese Unexamined Patent Application Publication No. 2009-63203

In the indoor unit in which the secondary side of the heat exchanger corresponds to a lower side, when an air-conditioned space is cooled, dew condensation water is generated on the surface of the heat exchanger. In an integrated heat exchanger that is not divided, dew condensation water moves along the fins of the heat exchanger, drops to a lower portion of the heat exchanger, and is eventually collected by the main drain pan. However, as mentioned above, when the heat exchanger is one that is divided into the upper heat exchanger and the lower heat exchanger and is used by being joined to each other, a joint exists in the entire heat exchanger. The joint gives rise to a state in which the fins of the heat exchanger are divided into an upper portion and a lower portion. Dew condensation water accumulated by surface tension on portions where the fins are divided is dispersed by gravitation and the action of wind that passes through the heat exchanger.

SUMMARY

The present invention is made to solve the above-described problem. It is an object of the present invention to provide an indoor unit of an air-conditioning apparatus capable of preventing dispersion of dew condensation water from an evaporator formed by connecting an upper heat exchanger and a lower heat exchanger of a divided heat exchanger.

According to one embodiment of the invention, an indoor unit of an air-conditioning apparatus includes a body casing having an air inlet and an air outlet, the air inlet being formed in an upper portion of the body casing, the air outlet being formed in a lower portion of the body casing; a ventilation passage that is formed in the body casing and that connects the air inlet and the air outlet to each other; an evaporator provided to a refrigerant circuit, disposed in an inclined manner in the ventilation passage, and that covers the ventilation passage such that air freely passes; a main drain pan that is disposed below the evaporator and that receives dew condensation water from the evaporator; and a fan that is disposed in the ventilation passage, wherein the evaporator is divided into an upper heat exchanger and a lower heat exchanger that is installed by being joined to a lower portion of the upper heat exchanger, and wherein a sub-drain pan is disposed at a downstream side in a ventilation direction of a joint between the upper heat exchanger and the lower heat exchanger, the sub-drain pan receiving dew condensation water that comes out from a gap of the joint.

In the indoor unit of the air-conditioning apparatus according to the embodiment of the invention, the sub-drain pan is disposed at the downstream side in the ventilation direction of the joint between the upper heat exchanger and the lower heat exchanger, each being a division structure of the evaporator. Therefore, when the heat exchanger is installed with the upper heat exchanger and the lower heat exchanger of the divided heat exchanger being connected to each other, even if the dew condensation water tends to be dispersed from the gap of the joint between the upper heat exchanger and the lower heat exchanger, the dew condensation water that comes out from the gap can be received. Consequently, it is possible to prevent the problem of causing damage when the dew condensation water is dispersed to the secondary side of the ventilation passage and is discharged into an underfloor duct from the air outlet.

DETAILED DESCRIPTION

Embodiment 1

Figure 1:
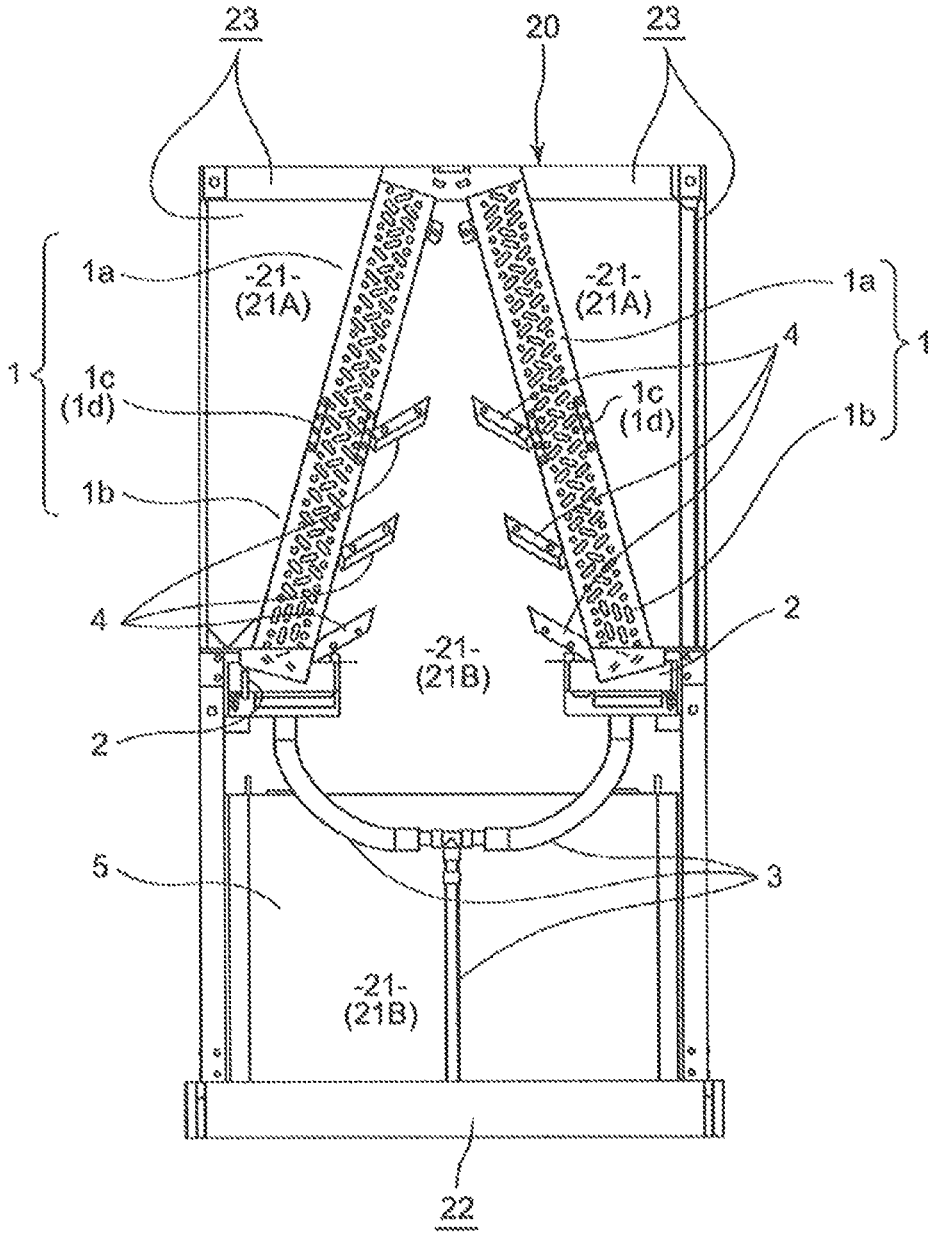
FIG. 1 is a schematic side structural view of an internal structure of an indoor unit of an air-conditioning apparatus in Embodiment 1 of the invention.
Figure 2:
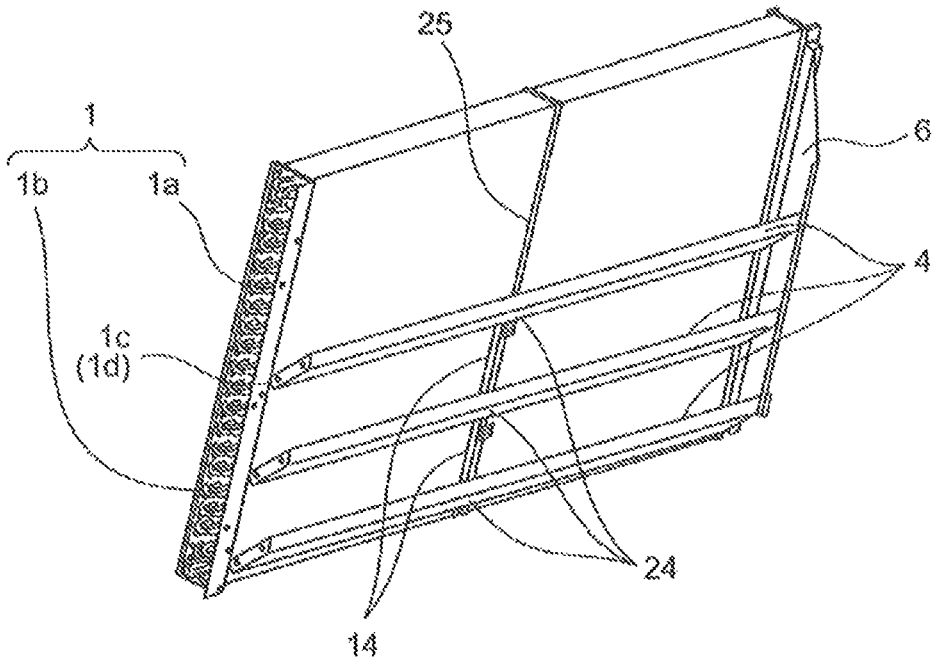
FIG. 2 is a perspective view of an evaporator, sub-drain pans, and side plates in the indoor unit.
Figure 3:
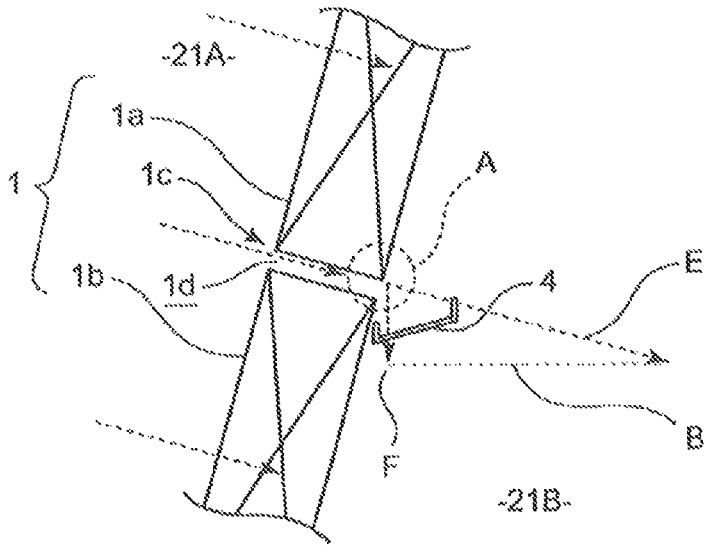
FIG. 3 is a partial side view for showing a positional relationship between the evaporator and one sub-drain pan in the indoor unit.
Figure 4:
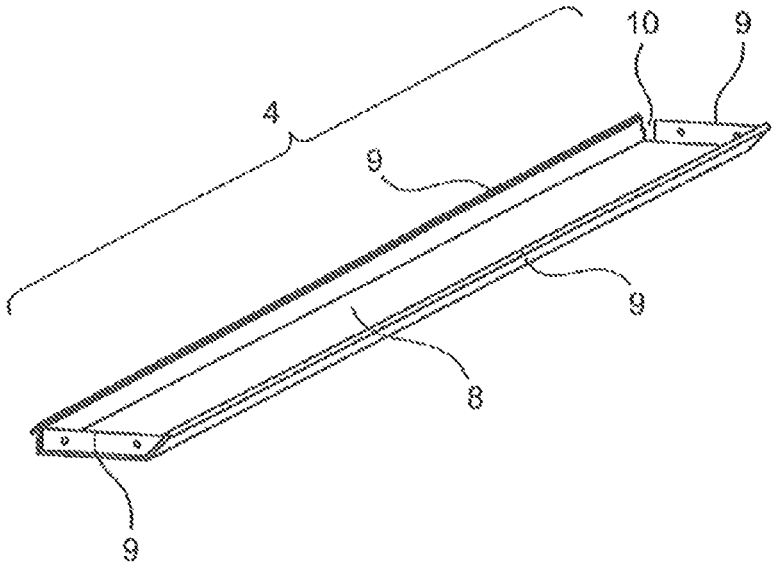
FIG. 4 is a perspective view of one sub-drain pan in the indoor unit.
Figure 5:
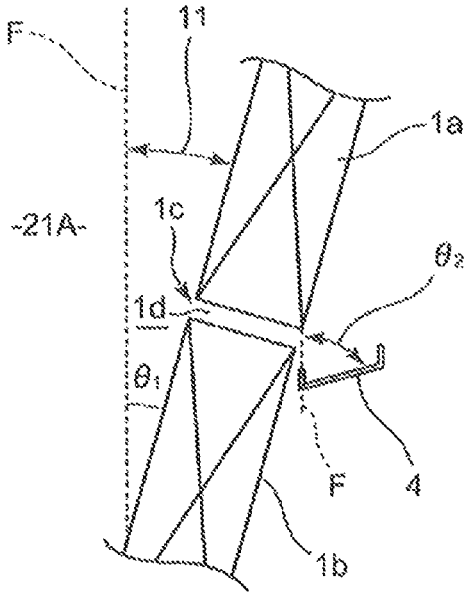
FIG. 5 is a partial side view for showing a relationship between an inclination angle of the evaporator and an inclination angle of one sub-drain pan in the indoor unit.

FIG. 1 is a schematic side structural view of an internal structure of an indoor unit of an air-conditioning apparatus in Embodiment 1 of the invention. FIG. 2 is a perspective view of an evaporator, sub-drain pans, and side plates in the indoor unit. FIG. 3 is a partial side view for showing a positional relationship between the evaporator and one sub-drain pan in the indoor unit. FIG. 4 is a perspective view of one sub-drain pan in the indoor unit. FIG. 5 is a partial side view for showing a relationship between an inclination angle of the evaporator and an inclination angle of one sub-drain pan in the indoor unit.

In each figure, the indoor unit of the air-conditioning apparatus in Embodiment 1 includes a body casing 20 having air inlets 23 and 23 and an air outlet 22, the air inlets 23 and 23 being formed in an upper portion of the body casing 20 and the air outlet 22 being formed in a lower portion of the body casing 20; a ventilation passage 21 formed in the body casing 20 and connecting the air inlets 23 and the air outlet 22 to each other; an evaporator 1 provided to a refrigerant circuit, disposed in an inclined manner in side view in the ventilation passage 21, and covering the ventilation passage 21 such that air freely passes; a main drain pan 2 disposed below the evaporator 1 and receiving dew condensation water from the evaporator 1; and a fan 5 disposed in the ventilation passage 21.

To reduce production cost, the evaporator 1 is divided into an upper heat exchanger 1*a* and a lower heat exchanger 1*b* that is installed by being joined to a lower portion of the upper heat exchanger 1*a*. The upper heat exchanger 1*a* and the lower heat exchanger 1*b* are mounted in the body casing 20 by being vertically connected by connecting fittings (not shown). A sub-drain pan 4 is disposed at a downstream side in a ventilation direction E at a location directly below a joint 1*c* between the upper heat exchanger 1*a* and the lower heat exchanger 1*b*. The sub-drain pan 4 receives dew condensation water that comes out from a gap 1*d* of the joint 1*c*. The sub-drain pan 4 includes a water receiving bottom plate 8 that receives dew condensation water and peripheral wall sections 9, 9, 9, and 9 that surround a periphery of the water receiving bottom plate 8 so as to prevent water leakage. A drainage port 10 is formed in a portion of the corresponding peripheral wall section 9. The water receiving bottom plate 8 and the peripheral wall sections 9, 9, 9, and 9 are formed from metal plates. The sub-drain pan 4 is disposed in an inclined manner such that an inclination angle θ2 of the water receiving bottom plate 8 with respect to a gravitation direction F of the sub-drain pan 4 is between an inclination angle θ1 of the evaporator 1 and a horizontal. That is, the position where dew condensation water can be collected by the sub-drain pan 4 is determined based on a relationship between the inclination angle θ1 of the evaporator 1 with respect to the gravitation direction F and the speed of air that passes through the gap 1*d* of the joint 1*c*. Two other sub-drain pans 4 and 4 are also disposed below the above-described sub-drain pan 4 disposed near the joint 1*c*. All of the sub-drain pans 4, 4, and 4 are primarily in contact with and mounted on the lower heat exchanger 1*b* of the evaporator 1.

Next, an operation is described.

In the indoor unit having the above-described structure, when a refrigerant circuit operates, the evaporator 1 cools air, and dew condensation water is generated on its surface. The dew condensation water moves along the surface of the evaporator 1, flows down onto the main drain pan 2, flows through a drain hose 3, and is discharged to the outside of the body casing 20. After dew condensation water that comes out from the evaporator 1 due to wind is collected by the sub-drain pan 4, the dew condensation water flows down from the drainage port 10 shown in FIG. 4 into the main drain pan 2 along a side plate 6.

Since the evaporator 1 is divided into the upper heat exchanger 1*a* and the lower heat exchanger 1*b*, the evaporator 1 has a structure in which dew condensation water tends to accumulate on a dew condensation water dispersion section A shown in FIG. 3 by surface tension, and in which, when a certain amount of dew condensation water accumulates, the dew condensation water tends to be dispersed from the evaporator 1 by gravitation and wind that passes through the evaporator 1. Consequently, the sub-drain pan 4 is disposed at a secondary side 21B of the evaporator 1 to allow the dew condensation water from the dew condensation water dispersion section A to be collected.

In Embodiment 1, the dew condensation water dispersed from the dew condensation water dispersion section A shown in FIG. 3 can be collected by disposing the sub-drain pan 4 at the secondary side 21B of the evaporator 1 as shown in FIG. 1. At this time, the position where the sub-drain pan 4 should be disposed is determined based on the inclination angle θ1 of the evaporator 1 and a passing speed of wind that passes through the evaporator 1.

FIG. 3 is a side view of the evaporator in which the lower portion of the heat exchanger corresponds to the secondary side, and one sub-drain pan. Since the dew condensation water drops due to gravitation that acts in the gravitation direction F and wind that passes through the evaporator 1 in the ventilation direction E, with the inclination angle θ1 of the evaporator 1, the passing speed, and the gravitation being considered, the sub-drain pan 4 is disposed in an inclined manner at a position allowing the sub-drain pan 4 to cover a dew condensation water dispersion range B shown in FIG. 3. At this time, considering a state in which wind does not flow, it is desirable that the sub-drain pan 4 have a plane area allowing the entire dew condensation water dispersion range B shown in FIG. 1 to be covered for collecting dew condensation water that drops directly downward. For example, when the inclination angle θ1 of the evaporator 1 is 15 degrees and the passing wind speed is 4 m/s, after 0.5 seconds, the dew condensation water is dispersed by 1*m* or more.

The further away the sub-drain pan 4 is from the evaporator 1, the larger area of the sub-drain pan 4 is needed. In other words, the closer the evaporator 1 and the sub-drain pan 4 are to each other, the more reliably the water can be collected by using the sub-drain pan 4 having a small area and the less ventilating resistance is offered. Therefore, it is desirable that the sub-drain pan 4 and the evaporator 1 be disposed close to each other.

FIG. 4 is a perspective view of one sub-drain pan. As shown in FIG. 4, the sub-drain pan 4 is in the form of a rectangular plate having an open top, and the water receiving bottom plate 8 thereof receives dew condensation water dispersed from the evaporator 1. The four sides of the water receiving bottom plate 8 are surrounded in a watertight manner by the peripheral wall sections 9, 9, 9, and 9 to prevent the dew condensation water collected by the water receiving bottom plate 8 from leaking. To discharge the collected dew condensation water from the drainage port 10, the sub-drain pan 4 is disposed in an inclined manner such that the drainage port 10 is at a lowest position.

FIG. 5 shows a relationship between the inclination angle of the evaporator and the inclination angle of one sub-drain pan. The inclination angle θ2 of the sub-drain pan 4 in a Y-axis direction is determined based on the inclination angle θ1 of the evaporator 1. Due to the disposition of the sub-drain pan 4 described above, if the inclination angle θ2 of the sub-drain pan 4 is less than or equal to the inclination angle θ1 of the evaporator 1, the water receiving bottom plate 8 of the sub-drain pan 4 cannot cover the dew condensation water dispersion range B (see FIG. 1). Therefore, the inclination angle θ2 of the sub-drain pan 4 is a gentler angle than the inclination angle θ1 of the evaporator 1.

If the inclination angle θ2 of the sub-drain pan 4 is greater than or equal to 90 degrees with respect to the gravitation direction F, the water receiving bottom plate 8 can no longer be inclined for discharge. Therefore, the inclination angle θ2 of the sub-drain pan 4 is greater than or equal to 12 degrees, which is equal to the inclination angle θ1 of the evaporator 1, and less than 90 degrees. However, as the inclination angle θ2 of the sub-drain pan 4 approaches 90 degrees, unless the area of the water receiving bottom plate 8 of the sub-drain pan 4 is increased, water can no longer be collected. Therefore, it is desirable that the inclination angle θ2 of the sub-drain pan 4 be close to the inclination angle θ1 (=12 degrees) of the evaporator 1.

As described above, in the indoor unit according to Embodiment 1, since the sub-drain pan 4 (4 at the topmost position in FIG. 1) is disposed at the downstream side in the ventilation direction E of the joint 1*c* between the upper heat exchanger 1*a* and the lower heat exchanger 1*b*, each being a division structure, the dew condensation water that comes out towards the secondary side 21B of the ventilation passage 21 from the gap 1*d* of the joint 1*c* can be received. Consequently, it is possible to prevent the problem of causing damage when the dew condensation water is dispersed to the secondary side 21B and is discharged into an underfloor duct (not shown) from the air outlet 22.

By disposing the sub-drain pan 4 at a position, where a dew condensation water is collectable, determined based on the relationship between the inclination angle θ1 of the evaporator 1 and the speed of air that passes through the gap 1*d* of the joint 1*c* and by disposing the water receiving bottom plate 8 of the sub-drain pan 4 in an inclined manner at the inclination angle θ2 that is between the inclination angle θ1 of the evaporator 1 and the horizontal, the dew condensation water that comes out from the gap 1*d* of the joint 1*c* can be reliably received by the sub-drain pan 4. In addition, since the sub-drain pan 4 is disposed in contact with the evaporator 1, the water receiving bottom plate 8 having a small area can be used, and the sub-drain pan 4 that is compact and low in cost can be provided. Since the sub-drain pan 4 includes the water receiving bottom plate 8, the peripheral wall sections 9, 9, 9, and 9, and the drainage port 10, the sub-drain pan 4 has a simple structure and can be provided at a low cost.

Embodiment 2

Next, Embodiment 2 in which the rigidity of a sub-drain pan is to be increased is described.

Figure 6:
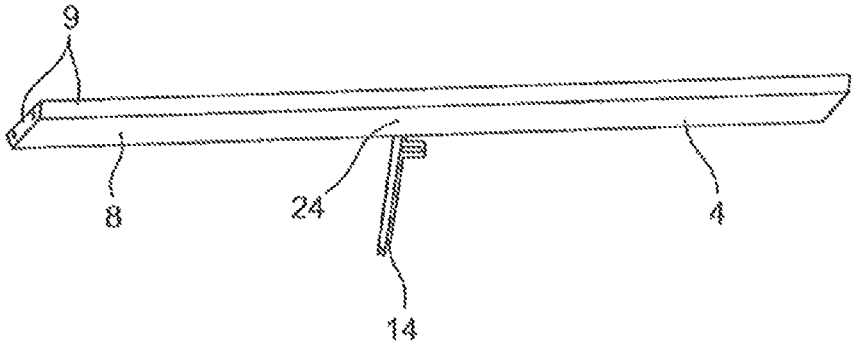
FIG. 6 is a perspective view of a sub-drain pan and a vibration preventing fixing fitting in an indoor unit of an air-conditioning apparatus in Embodiment 2 of the invention.

FIG. 6 illustrates a vibration preventing jig of a sub-drain pan in an indoor unit of an air-conditioning apparatus in Embodiment 2 of the invention. A heat exchanger having a high capacity is generally long in a stack length direction. As mentioned above, the length of the sub-drain pan 4 itself that is disposed at a secondary side 21B of an evaporator 1 and that needs to cover a joint 1*c* of the evaporator 1 needs to be equivalent to that of the evaporator 1. As a result, the rigidity of the sub-drain pan 4 cannot avoid being low. On the other hand, since wind strikes the sub-drain pan 4, the sub-drain pan 4 itself vibrates. In addition, as mentioned above, as the length of the sub-drain pan 4 is increased in a left-right direction, the amplitude is increased, and this may cause breakage of the sub-drain pan 4 itself caused by, for example, the dispersion of dew condensation water and metal fatigue.

Figure 7:
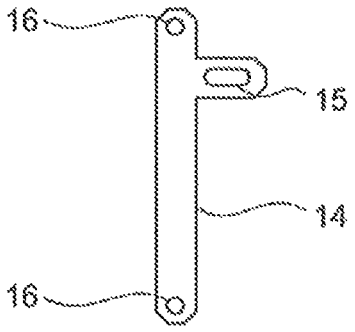
FIG. 7 is a back view of the fixing fitting of the indoor unit.

Accordingly, as means for preventing the aforementioned vibration, a vertically long plate 25 for preventing flexing of the heat exchanger is attached to a surface of a left-right-direction central portion at a downstream-side in a ventilation direction E of the evaporator 1. The vertically long plate 25 is connected to a left-right direction central portion 24 of each sub-drain pan 4 via a fixing fitting 14 shown in FIG. 7. Each fixing fitting 14 is a member having a substantially r-shape in back view and formed from a metal plate. Each fixing fitting 14 has threaded holes 16 and 16 that are formed in respective upper and lower end portions and used for fixing the sub-drain pans, and a threaded hole 15 for fixing the heat exchanger. Considering variations in parts, each threaded hole 15 has the shape of a long hole extending in the left-right direction. Each threaded hole 15 is fixed to the evaporator 1 with a screw, and the threaded holes 16 and 16 are fixed to the sub-drain pans 4 with screws.

As described above, the indoor unit according to Embodiment 2 includes the fixing fittings 14, and the sub-drain pans 4 are fixed to side plates 5 and 5 on respective left and right ends by the fixing fittings 14 at the center in the left-right direction, so that it is possible to increase the rigidity of the sub-drain pan 4 and to also reduce vibration.

In Embodiments 1 and 2 above, although the fan 5 is disposed at the secondary side 21B (the downstream side in the ventilation direction) of the ventilation passage 21, the invention includes, for example, a case in which the fan 5 is disposed at the primary side 21A (the upstream side in the ventilation direction) of the ventilation passage 21.

The invention claimed is:

1. An indoor unit of an air-conditioning apparatus, comprising:

a body casing having an air inlet and an air outlet, the air inlet being formed in an upper portion of the body casing, the air outlet being formed in a lower portion of the body casing;

a ventilation passage formed in the body casing and connecting the air inlet and the air outlet to each other;

an evaporator provided to a refrigerant circuit, disposed in an inclined manner in the ventilation passage, and covering the ventilation passage such that air freely passes;

a main drain pan disposed below the evaporator and receiving dew condensation water from the evaporator;

a fan disposed in the ventilation passage; and a sub-drain pan disposed only at a downstream side in a ventilation direction of the evaporator, the sub-drain pan receiving dew condensation water that comes out from a gap of the evaporator, wherein the sub-drain pan includes a water receiving bottom plate that receives the dew condensation water, and peripheral wall sections that surround, and attach to, a periphery of the water receiving bottom plate so as to prevent water leakage, at least two of the wall sections intersect and at least two other wall sections are spaced apart by a drainage port to drain the dew condensation water, the peripheral wall sections are each located on the downstream side of the evaporator.

2. The indoor unit of the air-conditioning apparatus of claim 1, wherein the sub-drain pan is disposed in contact with the evaporator.

3. The indoor unit of the air-conditioning apparatus of claim 1, wherein the sub-drain pan is disposed such that an inclination angle of the sub-drain pan with respect to a gravitation direction is between an inclination angle of the evaporator and a horizontal.

4. The indoor unit of the air-conditioning apparatus of claim 1, further comprising a vertically long plate mounted on a surface at a downstream-side in the ventilation direction of the evaporator, and a fixing fitting for connecting the vertically long plate and a central portion of the sub-drain pan in a left-right direction.

5. The indoor unit of the air-conditioning apparatus of claim 1, wherein the evaporator is divided into an upper heat exchanger and a lower heat exchanger joined to a lower portion of the upper heat exchanger, and wherein the sub-drain pan is disposed only at a downstream side in a ventilation direction of a joint between the upper heat exchanger and the lower heat exchanger.

6. The indoor unit of the air-conditioning apparatus of claim 5, wherein the sub-drain pan is disposed at a position where a dew condensation water is collectable, the position being determined based on a relationship between an inclination angle of the evaporator with respect to a gravitation direction and a speed of air that passes through the gap of the joint.

* * * * *